US005862676A

United States Patent [19]

Kim et al.

[11] Patent Number: 5,862,676

[45] Date of Patent: Jan. 26, 1999

[54] REFRIGERANT EXPANSION DEVICE

[75] Inventors: Jong-Youb Kim; Young-Dawn Bae; Eun-Chang Choi; Yong-Chan Kim, all of Suwon, Rep. of Korea

[73] Assignee: Samsung Electronics Co., Ltd., Suwon, Rep. of Korea

[21] Appl. No.: 879,197

[22] Filed: Jun. 19, 1997

[30] Foreign Application Priority Data

Feb. 18, 1997 [KR] Rep. of Korea ..... 1997-4861

[51] Int. Cl.[6] ..... F25B 41/06

[52] U.S. Cl. ..... 62/197; 137/513.3; 62/206; 62/511

[58] Field of Search ..... 62/196.1, 197, 62/205, 206, 511, 527, 324.6, 222, 224; 137/513.3, 513.7

[56] References Cited

U.S. PATENT DOCUMENTS 3,810,488 5/1974 Orth et al. ..... 62/217 X 3,953,984 5/1976 Widdowson ..... 62/196 X 5,186,021 2/1993 Keller ..... 62/511

*Primary Examiner*—Henry A. Bennett

*Assistant Examiner*—Susanne C. Tinker

*Attorney, Agent, or Firm*—Burns, Doane, Swecker & Mathis, L.L.P.

[57] ABSTRACT

A refrigerant expansion device for a refrigeration cycle comprises a housing, a passage formed penetrating the housing, an expansion means for expanding the refrigerant passing through the passage and a flow rate control means for bypassing some of the refrigerant passing through the expansion means according to the pressure of the refrigerant, for supplying to the low pressure portion of the passage, and for controlling the flow rate of the refrigerant through the expansion means.

5 Claims, 7 Drawing Sheets

REFRIGERANT EXPANSION DEVICE

BACKGROUND OF THE INVENTION

1. Field of the Invention

This invention relates to a refrigerant expansion device, and more particularly, to a refrigerant expansion device adaptable to a refrigeration cycle which controls the expansion valve of refrigerant flowing to a low pressure portion from a high pressure portion, and controls the flow rate of a refrigerant.

2. Description of the Prior Art

Generally, a refrigeration cycle is mainly comprised of a compressor, an evaporator, a condenser, and a refrigerant expansion device. A refrigerant under low pressure is compressed in the compressor. The refrigerant under high pressure enters into the condenser where it condenses. The refrigerant discharged from the refrigerant expansion device is expanded in the refrigerant expansion device to create a low pressure situation. Subsequently, the refrigerant is heat exchanged in the evaporator with the surrounding air.

There is a modified refrigeration cycle which performs in either refrigerating mode or heating mode. In this cycle, a 4-way valve determines the refrigerant is directed into either the indoor heat-exchanger or the outdoor heat-exchanger. This accomplishes the various functions of the refrigeration cycle. Further, the flow rate of the refrigerant being discharged can be controlled by the variation of the frequency of the compressor.

In this refrigeration cycle, the refrigerant expansion device performs a major function. The refrigerant expansion device enables the entering refrigerant to expand as the low pressure refrigerant, and the entrance of liquid refrigerant into the compressor is avoided. Further, the expansion device performs such that evaporated refrigerant at excessive temperature is prevented from entering into the compressor. Furthermore, the expansion device also sends to control the flow rate of refrigerant such that the expansion of the refrigerant entering from the condenser can be controlled.

There are three main types of refrigerant expansion devices commonly used: an electronic expansion valve, a capillary tube, and an orifice. The electronic expansion valve is a device whereby the temperature of refrigerant in the evaporator is detected and the flow rate of the refrigerant entering into the evaporator is controlled. The operation of the electronic expansion valve is performed by a variable passage in a needle valve inside the valve body. This device exhibits the high effect in the expansion of the refrigerant and the control of the flow rate of the refrigerant. However, the cost of the device is very high, and its structure is very complex. Furthermore, If the point of the temperature detection is far enough away, accurate detection can not be obtained.

In a capillary tube type device, even though the cost is much lower and it is very easy to manufacture, the installation work is very inconvenient because it is made with a 1 meter length of small diameter tube. In addition, since the flow rate of the discharged refrigerant is controlled in accordance with the varied frequencies of the compressor, there is a limit in the control of the refrigerating capacity of the refrigeration cycle. Moreover, the refrigerant is accelerated at the outlet of the capillary tube almost to the speed of sound(maximum permissible speed). Thus, the flow rate of the refrigerant under a high pressure reaches a limit when passing through the capillary tube.

In other words, as the RPM of the compressor increases, the flow rate of the discharged refrigerant is increased. However, the flow rate of the refrigerant which expands through the capillary tube and flows to the condenser cannot be increased anymore. The refrigerant which is not discharged from the capillary tube, remains at the outlet of the condenser, and a lack of refrigerant occurs in the evaporator. This contributes to a poor refrigerating capacity and low electrical efficiency for this refrigeration cycle.

When the compressor is operating at low RPM, the flow rate of the refrigerant discharged from the compressor is reduced. In the capillary tube, the flow rate of the refrigerant can not be controlled properly. Much more refrigerant than needed by the evaporator remains, thereby contributing poor capacity and low electrical efficiency for the refrigeration cycle.

For the above reasons, concentration on development of an inexpensive and simple refrigerant expansion device has been taking place.

One of the resulting devices is U.S. Pat. No. 5,134,860 issued on Aug. 4, 1992, and called 'variable area refrigerant expansion device having a flexible orifice for heating mode of a heat pump'. This device is comprised of an expansion chamber having an orifice passage for expanding the refrigerant, an intake opening at the inlet portion of the expanding chamber operated when in heating mode, and a check valve at the inlet portion of the expanding chamber operated when in cooling mode. The check valve is for preventing the return of the refrigerant. The orifice passage is made of flexible material and this expands or contracts according to the pressure of the refrigerant, thus controlling the flow rate of refrigerant discharged. When in heating mode, the refrigerant is taken in through the inlet opening and the check valve is in an opened position. The non-changed refrigerant flows through the expansion device. The expansion device is situated facing each direction between the indoor heat-exchanger and the outdoor heat-exchanger. Using this system, the heating mode, cooling mode, and the flow rate control mode are all accomplished simultaneously. If need be, only the heating mode or the heating and cooling mode can be utilized.

However, the expansion device needs a durable orifice tube which is made from an expandable material even at high temperatures. Moreover, an additional check valve is provided, so its manufacture and assembly is too complex and its cost is very high relation to a conventional capillary tube. As the pressure of the refrigerant taken in is increased, the orifice tube expands to increase the flow rate of the discharged refrigerant. This creates a problem with the relative expansion of the orifice passage contributing to poor expansion efficiency of the refrigerant.

SUMMARY OF THE INVENTION

The present invention is intended to overcome the above mentioned disadvantages and deficiencies of the prior art, as well as numerous others. It is an object of the present invention to provide a refrigerant expansion device in which the refrigerant entering from the high pressure portion is expanded into the low pressure portion in the refrigeration cycle, and the flow rate of the discharged refrigerant is controlled according to the pressure of the refrigerant.

It is a second object of the present invention to provide a refrigerant expansion device in which the refrigerant is expanded to the reduced pressure refrigerant, and the flow rate of the refrigerant is controlled in one direction, while the refrigerant can be circulated with non- expansion in the opposite direction.

It is a third object of the present invention to provide a refrigerant expansion device which is safe in the refrigeration cycle.

BRIEF DESCRIPTION OF THE DRAWINGS

The present invention may be better understood, and its numerous objects and advantages will be more apparent to those skilled in the art by reference to the accompanying drawings in which.

DETAILED DESCRIPTION OF THE PREFERRED EMBODIMENTS

The preferred embodiment of this invention will be described in detail with reference to the accompanying drawings.

Figure 1:
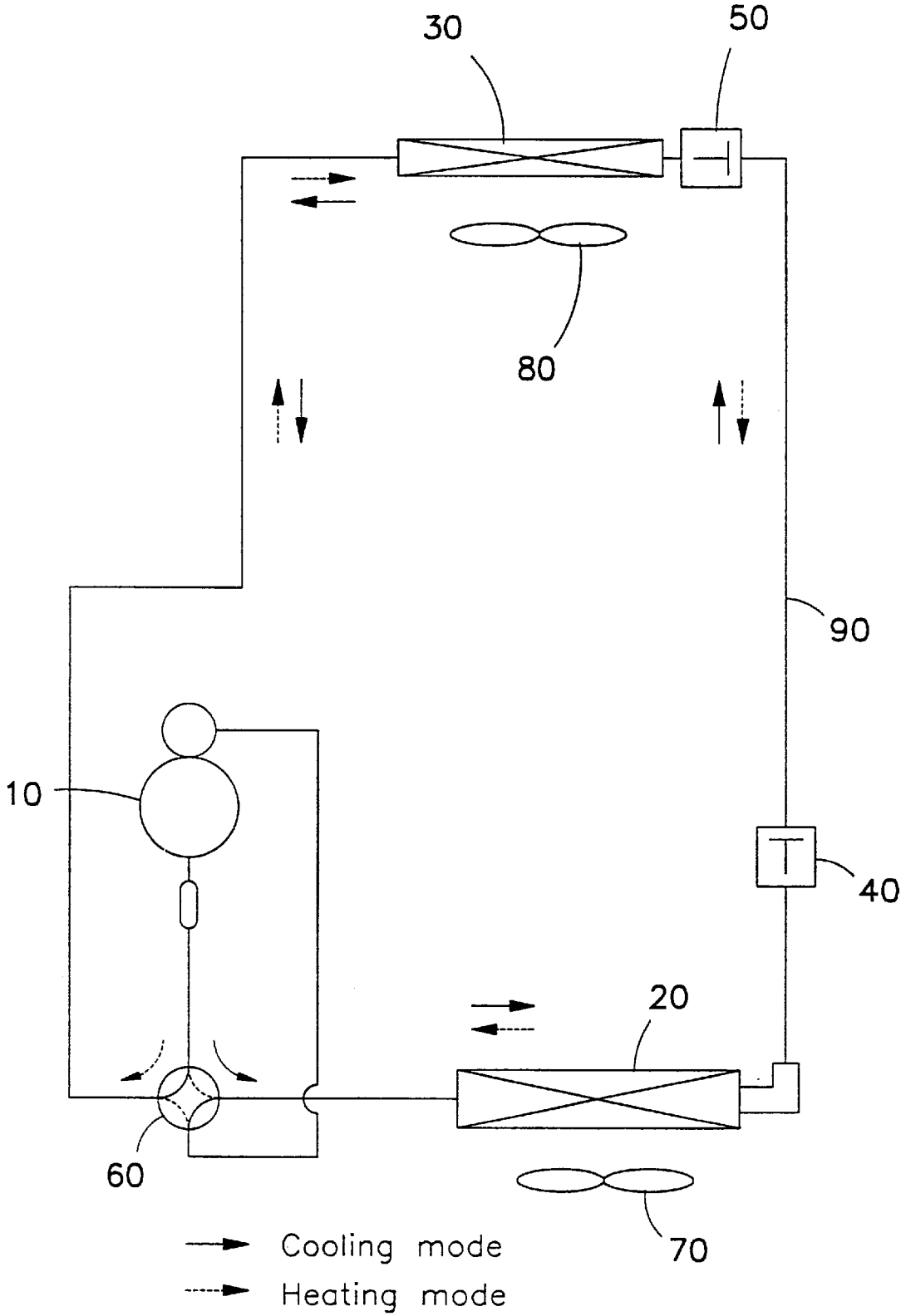
FIG. 1 is a schematic view of a refrigeration cycle having a refrigerant expansion device in accordance with the present invention.

A refrigeration cycle having a refrigerant expansion device of the present invention, as shown in FIG. 1, is comprised of a compressor 10, an indoor heat exchanger 30, an outdoor heat exchanger 20, a four way valve 60, an indoor refrigerant expansion device 50 and an outdoor refrigerant expansion device 40. When in a cooling mode, the low pressure refrigerant is compressed by the compressor 10 and is discharged to the outside heat exchanger 20 though the four way valve 60. The flow direction of the refrigerant is illustrated as a solid line shown in FIG. 1. In the outside heat exchanger 20, the refrigerant is heat-exchanged by the forced external air blow of the fan 70. The refrigerant in the outside heat exchanger 20 then passes through the outdoor refrigerant expansion device 40 so as to be expanded to be a low pressure refrigerant. Subsequently, the expanded refrigerant passes through the indoor heat-exchanger 30 and is heat-exchanged with indoor air by the fan 80. The phase-changed refrigerant then flows into the compressor for circulation along the above mentioned cycle.

Contrastingly, by the switching of the four way valve 60, the refrigerant can flow in the opposite direction of the cooling mode, thereby achieving warming mode or defrosting mode. In addition, the revolutions per minute (RPM) of the compressor 10 can be varied to control the flow rate of the refrigerant.

The refrigerant expansion deices 40,50 face each other on the refrigerant line 90 between the indoor heat-exchanger 30 and the outdoor heat-exchanger 20, so whether in cooling mode or warming mode, the refrigerant flowing from the indoor heat-exchanger 30 or the outdoor heat-exchanger 20 is reduced in its pressure and is expanded.

Figure 2:
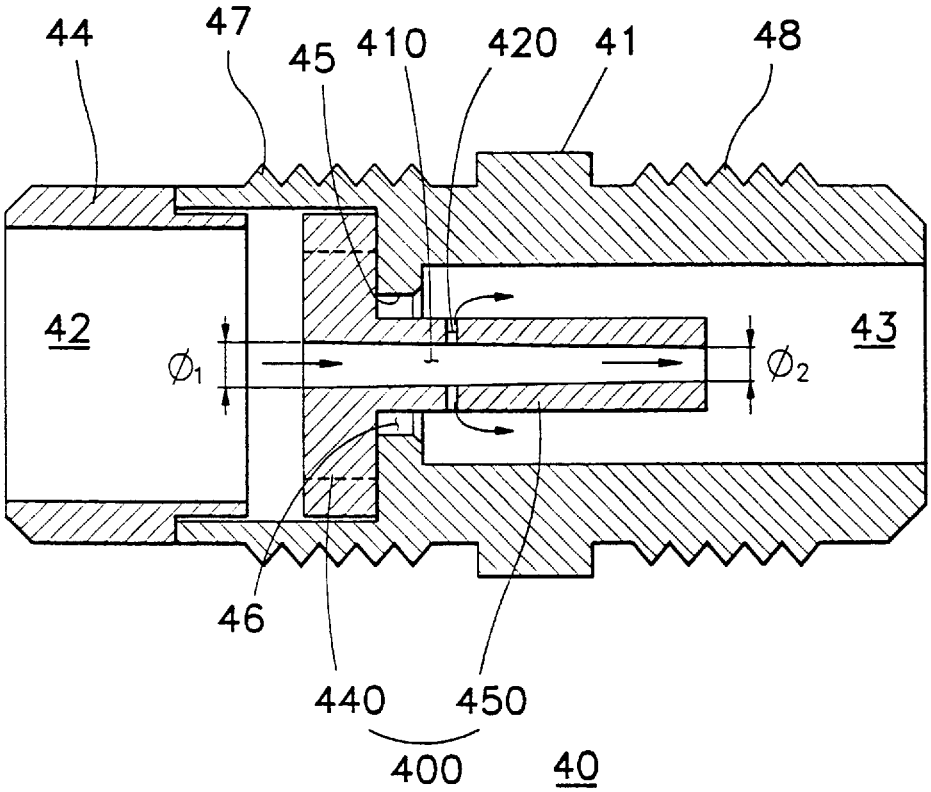
FIG. 2 is a longitudinal cross-section view of a refrigerant expansion device for an exterior in its expansion mode in accordance with the present invention.

Hereafter, the refrigerant expansion device for an exterior 40, which expands the high pressure refrigerant discharged from the outdoor heat exchanger 20, will be described. The refrigerant expansion device, as shown in FIG. 2, is comprised of an inlet portion 42, an outlet portion 43 and a housing 41 having a fluid passage therein. The housing 41 has thread parts 47,48 at both ends, and respective refrigerant pipes 90 are coupled with each thread part 47,48. In the housing there is a control piston 400 which has a tapered passage 410, a refrigerant bypass passage 420 and a pressure maintaining passage 430 (FIG. 3).

Figure 3:
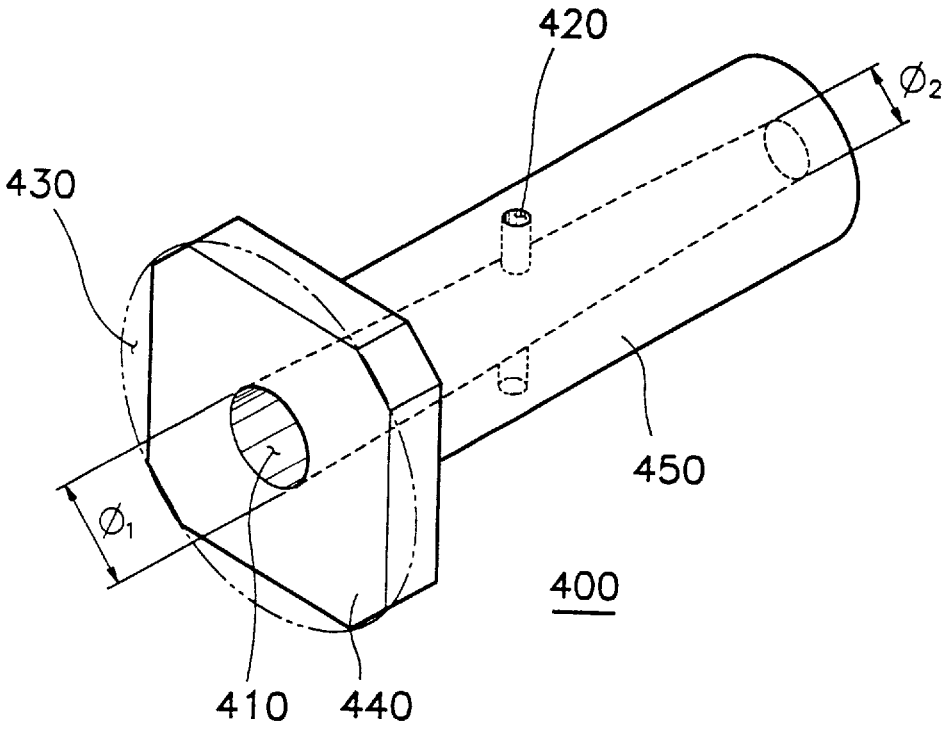
FIG. 3 is a perspective view of a control piston of the refrigerant expansion device of FIG. 2.

The control piston 400, as shown in FIG. 3, comprises a head portion 440 which is formed as a hexagonal or octagonal plate and a leg portion 450 which is extended from the head portion 440. The tapered passage 410 penetrates the head portion 440 and the leg portion 450 to maintain the throttle effect in the passage of the housing 41. The bypass passage 420 is provided in a predetermined area of the leg portion 450, where the pressure of the refrigerant is lowest in the tapered passage 410. The bypass passage 420 is formed perpendicular to the tapered passage 410. The inlet of the bypass passage 420 is interconnected with the tapered passage 410, while the outlet is interconnected with the portion serving as the low pressure part of the refrigerant expansion process. The tapered passage 410 has a gradually decreasing diameter such that the size θ1 of the inlet is greatest and is gradually decreased such that the diameter θ2 of the outlet portion is least.

The inlet portion 42 of the housing 41, which serves as the inlet only when in cooling mode of the refrigerant expansion device for an exterior 40, there is a support pipe 44 for restricting the movement of the head portion 440 of the control piston 400. The support pipe 44 makes contact with one surface of the head portion 440. At the interior middle point of the housing 41, there is a shoulder 45 which is in contact with the other surface of the head portion 440 and restricts the movement of the head portion 440. A throttle hole 46 defined by the formation of the shoulder 45 has enough size for the leg portion 450 of the control piston 400 to pass through. The head portion 440 moves only in the area between the support pipe 44 and the shoulder portion 45. The distance from the edge of the support pipe 44 inserted into the housing 41 to the adjacent surface of the shoulder portion 45 is larger than the thickness of the head portion 440. Thus, the head portion 440 can move left-hand or right-hand direction according to the direction which the refrigerant is flowing. Since the head portion 42 is hexagonal or octagonal in shape with rounded corners at each angle point, each rounded corner of the head portion 42 makes contact with the inner surface of the housing 41 to ensure the movement of the head portion 440, while each flat straight side of the head portion 440 is spaced away from the inner surface of the housing 41. The gap serves as a pressure maintaining passage 430. The passage 430 is closed when the control piston 400 is in refrigerant expansion mode, and the passage 430 is open when in all other modes in order to give a way to the opposite direction flowing refrigerant. In order for the refrigerant to cease flowing through the passage 430 when in the expansion mode, the shoulder 45 is extended such that it makes enough contact with the other surface of the head portion 440. Further, when the refrigerant is flowing in the other direction, the left-hand directional movement of the head portion 46 is restricted owing to the support pipe 44 fitted to the housing 41.

In the refrigeration cycle having a refrigerant expansion device 40 of the present invention, when in cooling mode, the low pressure refrigerant is compressed by the compressor 10 and flows into the outside heat exchanger 20 to be condensed by the heat-exchanging with the exterior air. The condensed refrigerant, which is discharged from the indoor heat exchanger 20, enters into the housing 41 of the refrigerant expansion device for the exterior 40. The refrigerant passing the inlet portion 42 pushes one surface of the head portion 440, and the opposite surface of the head portion 440 makes contact with the adjacent surface of the shoulder 45. Concurrently, the refrigerant flows into the tapered passage 410 which generates the throttle condition in the control piston 400. Because of the pressure differential between the inlet portion 42 and the outlet portion 43, the refrigerant in the outlet portion 43 is expanded so as to be under lower pressure. Some of the refrigerant entering the tapered passage 410 flows toward the bypass passage 420, and the low-pressure refrigerant is discharged through the outlet portion 43.

During the above operation, if the RPM of the compressor is varied, the cooling capacity as well as the flow rate of the refrigerant can be changed. With high RPM by the compressor 10, the pressure of the refrigerant entering into the expansion device 40 increases in proportion to the flow rate of refrigerant. Thus, the flow rate of the refrigerant discharged through the tapered passage 410 is increased partly and further the flow rate thereof is added due to the discharging refrigerant through the bypass passage 420. That is, as the refrigerant increases at the inlet of the tapered passage 410, the pressure inside the tapered passage 410 is increased, and the pressure of the inlet of the bypass passage 420 perpendicular to the tapered passage 410 is increased. The increase of the pressure of the bypass passage 420 leads an increase in the flow rate of the refrigerant discharged from the bypass passage 420. Therefore, the total discharging flow rate of the expansion device 40 is increased more.

Figure 4:
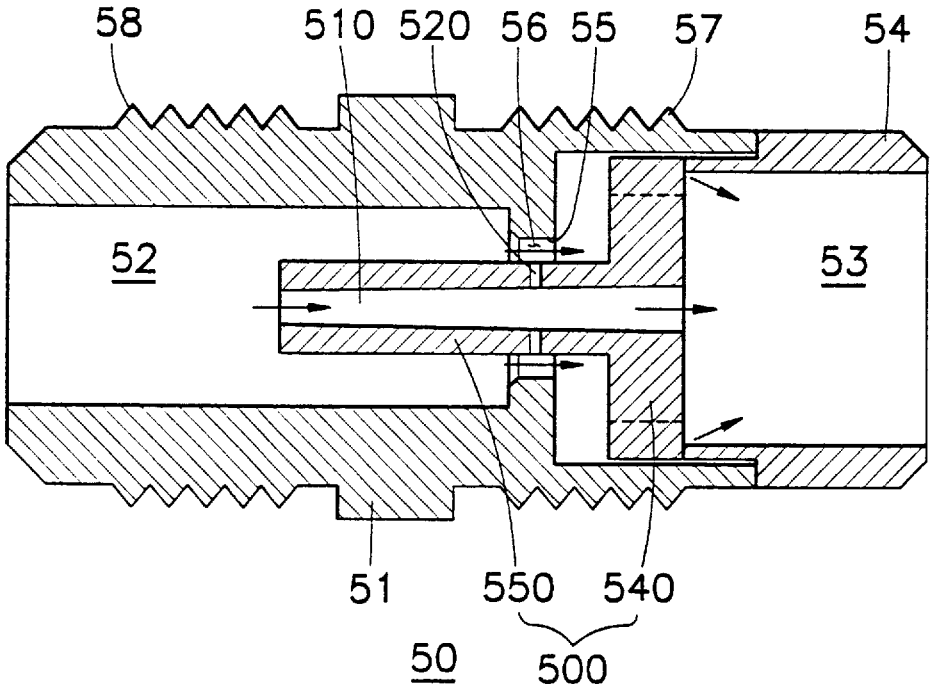
FIG. 4 is a longitudinal cross-section view of a refrigerant expansion device for the interior in its pressure holding mode in accordance to the present invention.

The refrigerant under low-pressure discharged from the refrigerant expansion device for the exterior 40 flows into the refrigerant expansion device for the interior 50. As shown in FIG. 4, a control piston 500 of the expansion device for the interior 50 faces the control piston 400 of the expansion device for the exterior 40. In the refrigerant expansion device for the interior 50, the refrigerant passing the inlet portion 52 first approaches a leg portion 550 of the control piston 500 which is slidably mounted. in a throttle hole 56. The refrigerant passed through the throttle hole 56 pushes the head portion 540 of the control piston 500 in the right-hand direction. Thus, the pressure maintain passage (not shown) which is formed between the control piston 500 and the housing 51 is opened so that the refrigerant is discharged to the outlet portion 53. The further movement of the control piston 500 is limited by the support pipe 54 fitted in the outlet portion 53 of the expansion device for the interior 50. Since the opening range of the refrigerant expansion device for the interior 50 is almost the same as that of the refrigerant expansion device for the exterior 40, the refrigerant does not decrease in its pressure when moving toward the indoor heat exchanger 30, thereby accomplishing the heat exchanging with the indoor air.

Contrastingly, as the switching of the 4-way valve 60, the flow direction of the refrigerant is reversed in the refrigeration cycle to achieve the heating or defrosting mode. The flow direction of the refrigerant is illustrated as the broken line shown in FIG. 1. The refrigerant discharged from the compressor 10 in the high pressure and high temperature condition flows into the indoor heat exchanger 30 first. The refrigerant entering the indoor heat exchanger 30 is heat-exchanged with the indoor air thus supplying warm air to the indoor space. The refrigerant used for the heat-exchanging flows into the refrigerant expansion device for the indoor 50. Because the flow direction of the refrigerant is the opposite of that in the above mentioned cooling mode, the expansion of the refrigerant to be decreased in pressure occurs in the refrigerant expansion device for the interior 50. Its operation is precisely the same as that of the refrigerant expansion device for the exterior 40, so its detailed description will be omitted. The refrigerant further advances to the expansion device for the exterior 40 via the refrigerant line 90. The refrigerant discharged from the expansion device for the interior 40 at an unchanged pressure value, flows into the outdoor heat exchanger 20 to heat-exchange with the outdoor air. Then, the refrigerant flows into the compressor 10. The refrigerant thus circulates in the cycle of the refrigerating mode.

Hereafter, the experimental data in respect to the operation of the inventive device will be described in detail with reference to the accompanying graph drawings.

Figure 5:
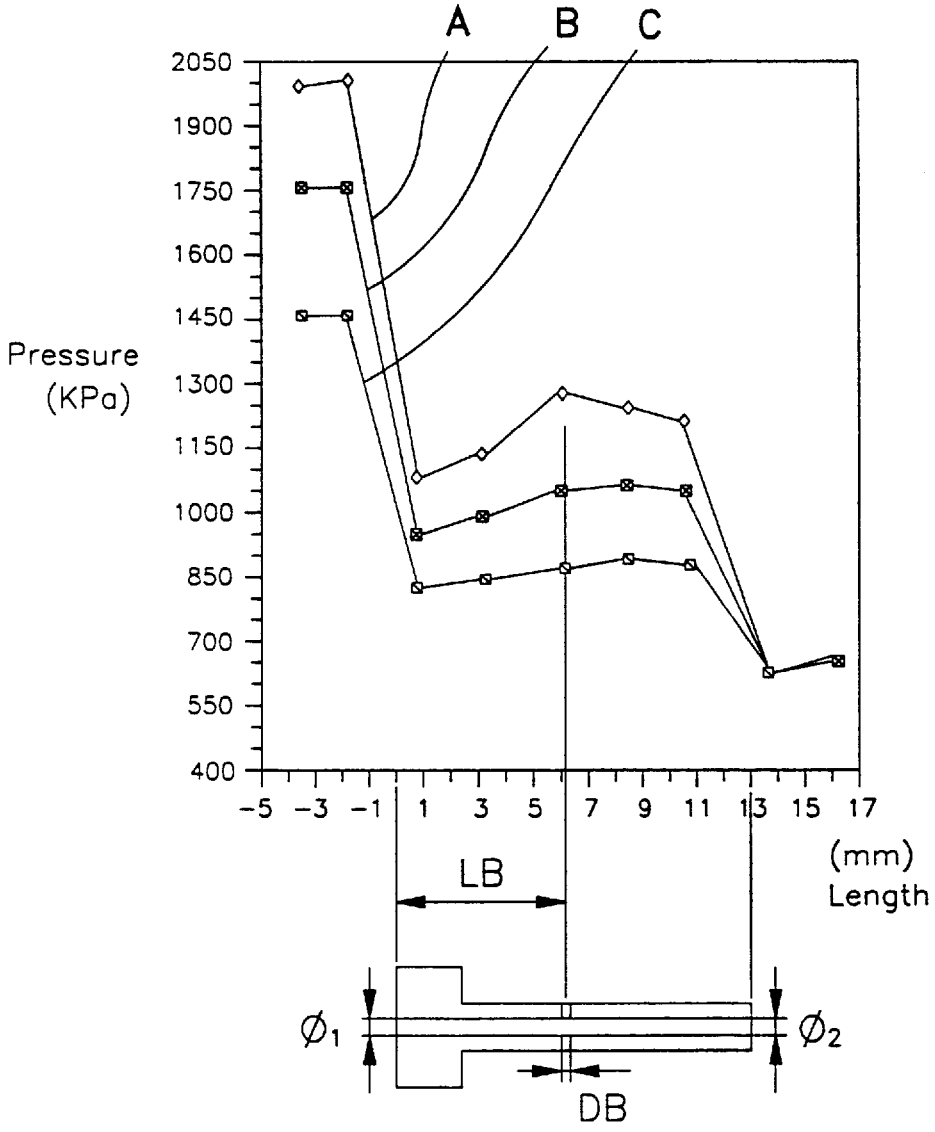
FIG. 5 is a graph illustrating the internal pressure of a reducing passage of a refrigerant expansion device for the present invention.

FIG. 5 illustrates the experimental data showing the pressure of the refrigerant adapted to the inventive device. The longitudinal length of the tapered passage is 12.83 mm, the largest diameter of the tapered passage is 1.33 mm, and HCFC-22 is employed as the refrigerant. Each pressure of the entered refrigerant is set as various value, i.e. 2000 kPa(A), 1724 kPa(B), and 1446 kPa(C). In respective different conditions, the mass flow rate of the discharged refrigerant is 140 kg/h, 130 kg/h, and 121 kg/h, respectively. The pressure reduction created at the outlet portion of the tapered passage is 627 kPa. Its temperature is 13.9° C. The pressure of the location where the flow resistance in the tapered passage is largest, is 1350 kPa. Its location is about 6 mm from the inlet portion of the tapered passage. The bypass passage is formed at that point so that the efficiency of the tapered passage and the flow rate of the refrigerant can be controlled.

Figure 6:
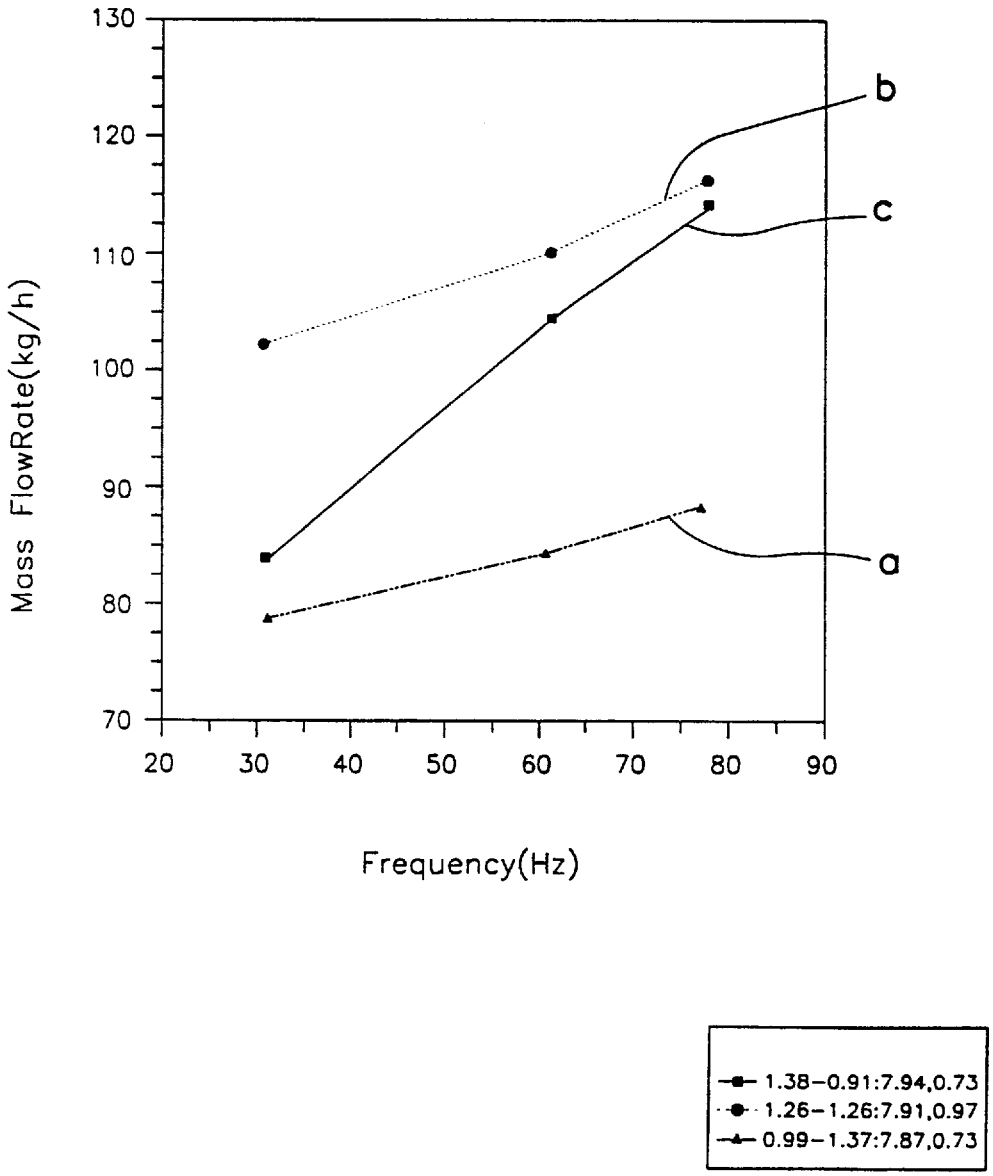
FIG. 6 is a graph illustrating mass flow rates of a refrigerant in respect to various sizes of taper angle of a reducing passage for the present invention.

FIG. 6 is a graph illustrating mass flow rates of a refrigerant in respect to various sizes of taper angle of a tapered passage in accordance with the present invention. The ideal size for the tapered passage and position and size of the bypass passage is defined by this graph.

Under three different conditions the experiment is performed. For "a", the diameter of the inlet portion of the tapered passage θ1 is set at 1.38 mm, that of the outlet portion of the tapered passage θ2 is set at 0.91 mm, and a length LB from the inlet portion of the tapered passage to that of the bypass passage is set at 7.94 mm. Further, a diameter DB of the bypass passage is set at 0.73 mm, and its taper angle is set at 0.87°.

For "b", the diameter of the inlet portion of the tapered passage θ1 is set at 1.44 mm, that of the outlet portion of the tapered passage θ2 is set at 0.93 mm, and a length LB from the inlet portion of the tapered passage to that of the bypass passage is set at 7.9 mm. Further, a diameter DB of the bypass passage is set at 0.73 mm, and its taper angle is set at 0.97°.

Finally, for "c", the diameter of the inlet portion of the tapered passage θ1 is set at 1.47 mm, that of the outlet portion of the tapered passage θ2 is set at 0.92 mm, and the length LB from the inlet portion of the tapered passage to that of the bypass passage is set at 7.85 mm. Further, the diameter DB of the bypass passage is set at 0.73 mm, and its taper angle is set at 1.0°.

In each situation, the frequency of the compressor is varied from 30 Hz to 80 Hz. The measuring is carried out at determined points, i.e. 30 Hz, 60 Hz, and 80 Hz. The voluminous increment value of refrigerant in each point is 18%, 36%, and 49%, respectively.

The major cause of the difference in the graphs may be considered to be a result of the evaporating point of the bypass passage and the position of the pressure restoration. Further, as the taper angle is increased the cross-section of the bypass passage is changed inversely. The previous distance of the pressure is shortened and the point of the pressure restoration approaches toward the inlet portion of the tapered passage. Also, the evaporating point is moved forward. When the frequency and the taper angle are increased, the refrigerant of the inlet portion of the bypass passage becomes two phase or one phase, otherwise the pressure thereof is highly variable. This may effect the variance of the flow rate of the refrigerant.

Figure 7:
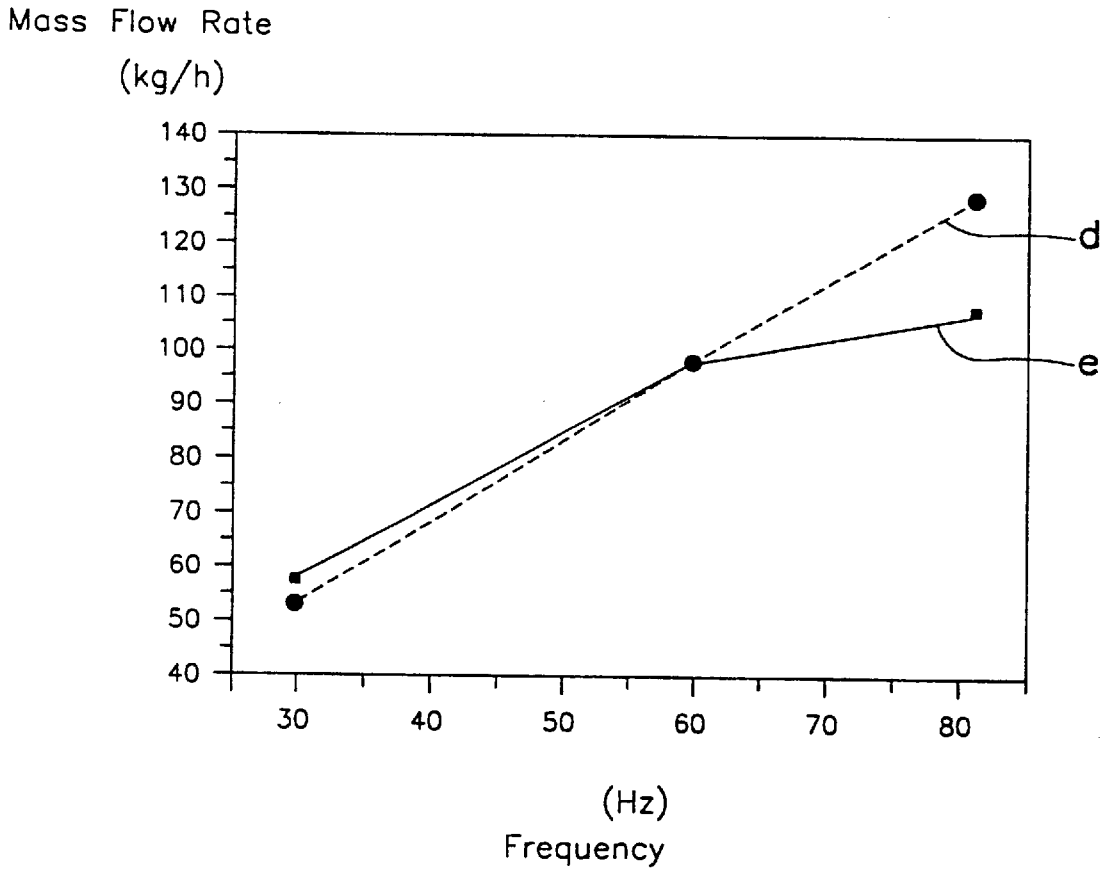
FIG. 7 is a graph illustrating mass flow rates of a refrigerant in respect to various sizes of taper angle of a reducing passage for the prior art.

FIG. 7 is a graph illustrating mass flow rates of the discharged refrigerant between the inventive refrigerant expansion device d and a conventional capillary tube e in respect to frequency of a compressor. The band of the frequency of the compressor is from 30 Hz to 80 Hz. The flow rate of the refrigerant in the capillary is 76 kg/h at 30 Hz. The flow rate of the refrigerant in the inventive device is 75 kg/h. This is less than the conventional device by 2.4%. At 80 Hz, the flow rate of the refrigerant in the capillary is 107 kg/h. The flow rate in the inventive device is 103.5 kg/h. This is less than the conventional device by 3.4%.

As detailed in the above description, in the refrigerant expansion device of the present invention, the mass flow rate of the discharged refrigerant can be properly varied using an additional bypass passage. Further, the shape of the tapered can widen the variant band of the frequency of the refrigerant, thereby conveniently controlling the capacity of the refrigeration cycle.

What is claimed is:

1. A refrigerant expansion device for a refrigeration cycle comprising:

a housing;

a passage formed penetrating the housing;

an expansion means for expanding the refrigerant passing through the passage; and a flow rate control means communicating an upstream high pressure portion of the passage with a downstream low pressure portion of the passage for bypassing some of the refrigerant passing through the expansion means according to the pressure of the refrigerant, for supplying to the low pressure portion of the passage, and for controlling the flow rate of the refrigerant of the expansion means;

wherein the expansion means provides a pressure reducing passage having an inlet end communicating with the high pressure portion, and an outlet end communicating with the low pressure portion, and the flow rate control means includes a bypassing passage having one end connected to the low pressure portion and another end connected to the pressure reducing passage at a location between the inlet and outlet ends thereof.

2. A refrigerant expansion device for a refrigeration cycle as claimed in claim 1, wherein the other end of the bypassing passage is located at a highest pressure point of the reducing passage.

3. A refrigerant expansion device for a refrigeration cycle as claimed in claim 1, wherein the cross-section of the reducing passage is tapered from the inlet end thereof to the outlet end thereof.

4. A refrigerant expansion device for a refrigeration cycle as claimed in claim 1, wherein the housing comprises a support means by which the expansion means is movably mounted in the inside of the housing and both ends of the expansion means are supported.

5. A refrigerant expansion device for a refrigeration cycle as claimed in claim 4, wherein the housing has a pressure maintaining passage through which the refrigerant flows withholding the pressure, and the support means has a smaller diameter than that of the pressure maintaining passage for closing/opening the pressure maintaining passage.

* * * * *